US007410135B1

(12) United States Patent
Dibble et al.

(10) Patent No.: US 7,410,135 B1
(45) Date of Patent: Aug. 12, 2008

(54) REUSABLE HOLDING SYSTEM FOR PYROTECHNIC, SHAFT BEARING DEVICES

(76) Inventors: Mark Dibble, 279 White Birch Dr., Waterbury, CT (US) 06708; Robert Budnik, 49 Heritage Dr., Prospect, CT (US) 06712; Eric Wider, 8 Aaron Rd., East Haven, CT (US) 06512

( * ) Notice: Subject to any disclaimer, the term of this patent is extended or adjusted under 35 U.S.C. 154(b) by 183 days.

(21) Appl. No.: 11/377,968

(22) Filed: Mar. 17, 2006

Related U.S. Application Data

(60) Provisional application No. 60/664,982, filed on Mar. 24, 2005.

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 5/06*** | (2006.01) |
| ***E04G 3/00*** | (2006.01) |
| ***F21V 21/00*** | (2006.01) |
| ***F21V 35/00*** | (2006.01) |

(52) U.S. Cl. ..... 248/220.21; 248/201; 248/235; 248/239; 248/309.1; 248/534; 248/407; 248/408; 248/409; 248/159; 248/535; 403/109.3; 403/109.8; 403/325; 211/105.1; 102/358; 102/20; 102/22

(58) Field of Classification Search ..... 248/201, 248/220.21, 235, 239, 309.1, 407–409, 159, 248/534, 535; 211/105.1; 102/358, 20, 22; 403/109.3, 109.8, 325

See application file for complete search history.

(56) References Cited

U.S. PATENT DOCUMENTS

| | | | | | |
|---|---|---|---|---|---|
| 329,442 | A | * | 11/1885 | Dax | 102/344 |
| 1,620,561 | A | | 3/1927 | Kohn | |
| 1,634,232 | A | | 6/1927 | Moushon | |
| 1,845,381 | A | * | 2/1932 | Wiley | 102/358 |
| 2,093,447 | A | | 9/1937 | Jones | |
| 2,129,039 | A | * | 9/1938 | Schooley | 102/358 |
| 2,234,864 | A | * | 3/1941 | Jackson | 42/54 |
| 2,268,213 | A | | 12/1941 | Hunnicutt | |
| 3,594,033 | A | * | 7/1971 | McLemore | 294/19.1 |
| 3,869,987 | A | | 3/1975 | Berchielli | |
| 5,148,723 | A | * | 9/1992 | Newman et al. | 81/53.11 |
| 5,361,446 | A | * | 11/1994 | Rufo | 15/167.1 |
| 6,151,713 | A | | 11/2000 | Dunn | |

* cited by examiner

*Primary Examiner*—Anita M. King
*Assistant Examiner*—Nkeisha J Dumas
(74) *Attorney, Agent, or Firm*—Melvin I. Stoltz

(57) ABSTRACT

By providing a hand holdable, reusable, holding system which enables users to insert any small diameter, shaft supporting pyrotechnic device, such as a sparkler, into an aperture and be assured that the shaft of the pyrotechnic device is securely locked to the holding system for protecting the individual from harm, an easily constructed, easily used holding system is attained which is capable of enabling any elongated, small diameter wire or shaft to be quickly inserted into the holding system and securely lockingly engaged therewith. In this way, the pyrotechnic material which is adhered to the upper portion of the elongated shaft or wire is easily held by the user in a safe and effective manner.

10 Claims, 3 Drawing Sheets

20
37
36
23
38
24
31
26
25
21
30
27
22
29
28

28
23
31
30
21
26
29
27
25
32

28
23
25
30
24
29
42
36
27
31

REUSABLE HOLDING SYSTEM FOR PYROTECHNIC, SHAFT BEARING DEVICES

RELATED APPLICATIONS

This application is related to U.S. Provisional Patent Application Ser. No. 60/664,982, filed Mar. 24, 2005 entitled NOVELTY SPARKLER HOLDER.

TECHNICAL FIELD

This invention relates to holding systems and, more particularly, to hand-held holders for sparklers, punks, and other pyrotechnic devices.

BACKGROUND ART

For many years, people have been entertained by pyrotechnic devices such as sparklers, punks and the like, particularly during patriotic holidays such as Memorial Day and the Fourth of July. In addition, many children wish to emulate adults by holding and waving sparklers and punks to show their enthusiasm.

Once thought of as something to be used only on holidays alone, sparklers are now being used in many other types of celebrations. In this regard, sparklers are now finding their way into many areas, such as weddings and parties. With an exciting show of gold sparks, the sparkler can be used indoors and outdoors and can be held by guest to form an arch or passageway through which the married couple passes. They can be used as party favors and placed beside each place setting on a table at a reception or party. They can be painted to match a color scheme or theme and even placed on a cake to produce a light show effect.

Sparklers are designed to burn over a long period of time (up to a minute) and produce extremely bright and showering light. Sparklers are often referred as "snowball sparklers" because of the ball of sparks that surround the burning portion of the sparkler.

The sparkler consists of a fuel composed of charcoal and sulfer, an oxidizer such as potassium nitrate, iron or steel powder, and a binder which can be made of sugar or starch. Once these components are mixed with water, these chemicals form a slurry which can be coated on a wire by dipping.

After the composition has dried on the wire, the sparkler is complete and ready for use. When a sparkler is ignited, it burns from the lit end down to the bottom. The fuel and oxidizer are proportioned, along with the other chemicals, resulting in a sparkler that burns slowly.

However, during this burning process the wire to which the sparkler composition is adhered can become very hot and burn the hand. In addition, the sparks emitted from the sparklers can burn the skin, particularly the tender skin of young children.

Therefore, it is a principal object of the present invention to provide a hand held holding device in which a sparkler or other pyrotechnic device is retained to protect the skin.

Another object of the present invention is to provide a hand held holding device having the characteristic features described above which can be reused.

A further object of the present invention is to provide a hand held holding device having the characteristic features described above which is colorful and will add to the excitement and enjoyment of the user.

A further object of the present invention is to provide a hand held holding device having the characteristic features described above which is completely reusable, thereby being both safe and effective, as well as cost efficient.

Other and more specific objects will in part be obvious and will in part appear hereinafter.

SUMMARY OF THE INVENTION

By employing the present invention, all of the drawbacks and difficulties found in the prior art have been eliminated and a safe, effective, and reasonably priced hand holdable product is realized which enables users to enjoy light emitting products such as sparklers and other pyrotechnic devices. In accordance with the present invention, a hand holdable, reusable, sparkler holding system is attained which enables users to insert any small diameter, shaft supporting pyrotechnic device, such as a sparklers, into an aperture and be assured that the shaft of the pyrotechnic device is securely locked to the holding system for protecting the individual from harm.

In the preferred embodiment of the present invention, an easily constructed, easily used holding system is attained which is capable of enabling any elongated, small diameter wire or shaft to be quickly inserted into the holding system and securely lockingly engaged therewith. In this way, the pyrotechnic material which is adhered to the upper portion of the elongated shaft or wire is easily held by the user in a safe and effective manner. Furthermore, by employing the present invention, any pyrotechnic construction employing small diameter shafts or wires can be quickly and easily securely mounted to the holding system of the present invention for use with safety and security.

Preferably, the holding system of the present invention is constructed from molded, flame retardant material and comprises an elongated, cylindrically shaped shaft in combination with a flange or plate radially extending outwardly from the shaft. In the preferred construction, the radially extending flange is formed at one terminating end of the shaft. However, if desired, the flange can be constructed extending from any desired location along the length of the shaft.

In the preferred construction, the flange is employed as added protection to the user for assuring that any sparks emanating from the pyrotechnic device are incapable of reaching the user. In this regard, in typical use of the holding system of the present invention, the user would insert the shaft of the pyrotechnic device into a clamp member assembly integrally formed in the holding shaft, and then hold the elongated shaft in a position away from the individual's body. By employing the enlarged radially extending flange, added protection is provided for deflecting any sparks that may fall close to the hand of the user grasping the shaft of the holding system.

In order to achieve a holding system which is capable of being constructed in a cost effective, competitive manner, the elongated shaft and flange are formed as a molded product constructed from one or two separate components. In the preferred construction, two components are employed, with the components constructed for being quickly and easily securely affixed to each other to form an integral final assembly.

In addition, the preferred embodiment of the present invention incorporates a lower shaft member which is constructed for being quickly and easily securely affixed to an upper shaft and flange member. Furthermore, the upper shaft and flange of member incorporates a central aperture formed in the flange for enabling the shaft of the pyrotechnic device to be inserted therein, with a cylindrically shaped hollow section extending from the flange.

In the preferred construction, a flat disc is mounted between the two mating sections thereby forming a base to the hollow cylindrical end. In this way, the shaft of the pyrotechnic device is quickly and easily inserted into the aperture of the flange and is extended therethrough until contacting the stop disc of the upper shaft and flange member.

Furthermore, the holding system of the present invention also incorporates a locking assembly constructed for being engageable with the shaft of the pyrotechnic device in secure, locked, engageable therewith. In this way, the user is able to insert the shaft of the pyrotechnic device into the aperture of the flange, and advance the shaft into secure, locked interengagement with the locking assembly. Once secure interengagement has been attained, the pyrotechnic device is affixed and locked in position with the holding system of the present invention, assuring that the pyrotechnic device is virtually incapable of being accidentally dislodged or separated therefrom.

In accordance with the present invention, many alternate constructions and configurations can be employed for providing a locking assembly integrally formed with the holding system. However, in the preferred embodiment, an easily constructed, and easily assembled pushbutton initiated locking system is employed. In this regard, the preferred locking system of the present invention incorporates a cylindrically shaped, button forming member, a button holder or retainer, and a spring member. By employing these simple components and mounting these components in the elongated shaft in cooperating relationship with the aperture of the flange, a highly effective, inexpensive, easily employed and reliable locking system and pyrotechnic holding assembly is realized.

As is more fully detailed below, the cylindrically shaped, button forming member is constructed with fins or ridges radially extending from the outside surface thereof. In addition, the button holder/retainer is constructed for peripherally surrounding the button forming member and incorporates slots formed therein cooperating with the radially extending ridges or fins. In addition, the spring member is mounted to the base of the cylindrically shaped button forming member, continuously biasing the button forming member in an upward direction.

By employing this construction, the button forming member is axially movable relative to the holder/retainer, with the axial movement thereof being limited by the engagement between the radially extending flanges/fins and the cooperating slots of the holder/retainer. In this way, controlled axial movement of the button forming member is attained. Furthermore, the button forming member incorporates a passageway formed therein which is positioned for being aligned with the aperture formed in the flange of the upper portion of the handle member.

Finally, the holder/retainer incorporates a side wall position for cooperating relationship with the passageway of the button forming member, controlling the opening and closing of the passageway based upon the axial movement of the button forming member. In this way, the shaft of the pyrotechnic device can be inserted through the aperture of the flange as well as the passageway of the button forming member when the button forming member is in a first position, which is achievable only by counteracting the spring biasing force being imposed thereon.

Once this counteracting force is removed, the spring member forces the button member to move in an upward direction relative to the handle, attempting to cause the passageway to become aligned with the side wall of the holder/retainer. However, whenever the shaft of the pyrotechnic device is inserted in the passageway of the button forming member, the shaft is lockingly engaged in the passageway due to the spring biasing force pushing the shaft in the passageway into engagement with the side wall of the holder/retainer. As a result, the pyrotechnic device is securely locked in the shaft of the holding system, prevented from being removed therefrom until a force is applied to the pushbutton member to counteract the spring biasing force.

As is evident from the foregoing detailed discussion, the holding system of the present invention is constructed in a highly effective, easily achieved manner, producing a holding system which is capable of providing secure, locked interengagement with any pyrotechnic device whenever desired, as well as complete release of the device for removal whenever appropriate. In this way, all of the difficulties and drawbacks found in the prior art systems are eliminated and a safe, effective, and reasonably priced holding system is attained.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1-7, along with the following detailed discussion, the construction and operation of the preferred embodiment of the pyrotechnic holding system of the present invention can best be understood. In addition, as will be evident from the following disclosure, alternate embodiments of the present invention can be constructed without departing from the scope of the present invention. Consequently, it is to be understood that the following detailed disclosure, as well as the embodiment shown in FIGS. 1-7, are provided for exemplary purposes only and are not intended as a limitation of the present invention.

Figure 1:
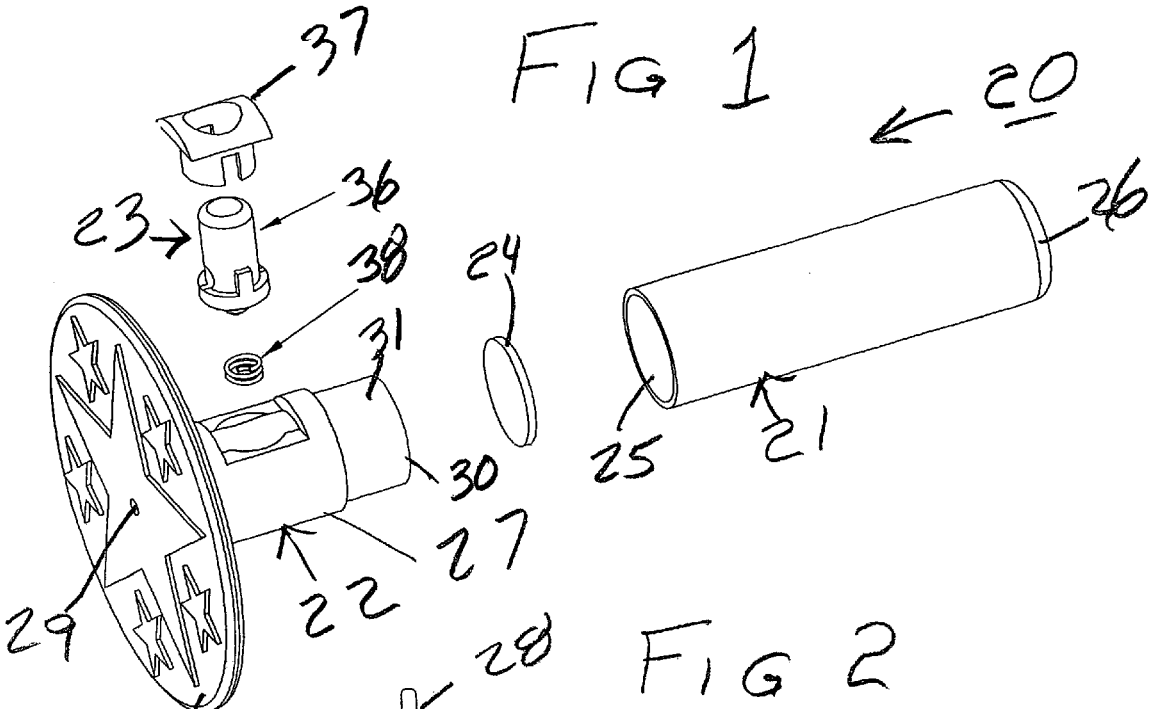
FIG. 1 is an exploded perspective view the holding system of the present invention.
Figure 2:
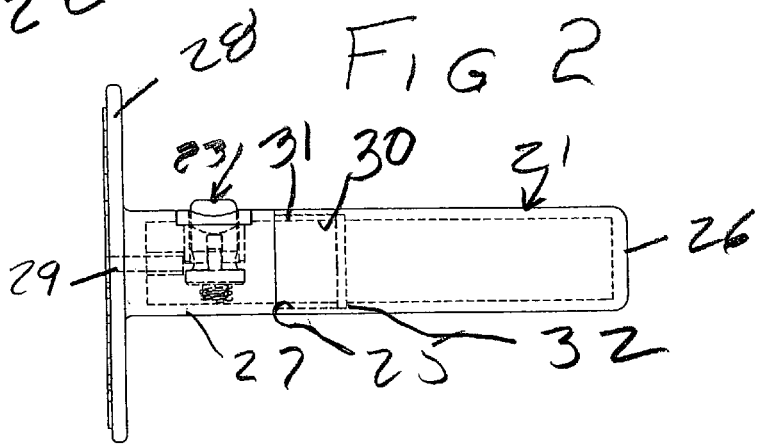
FIG. 2 is a side elevation view of the holding system of the present invention.
Figure 3:
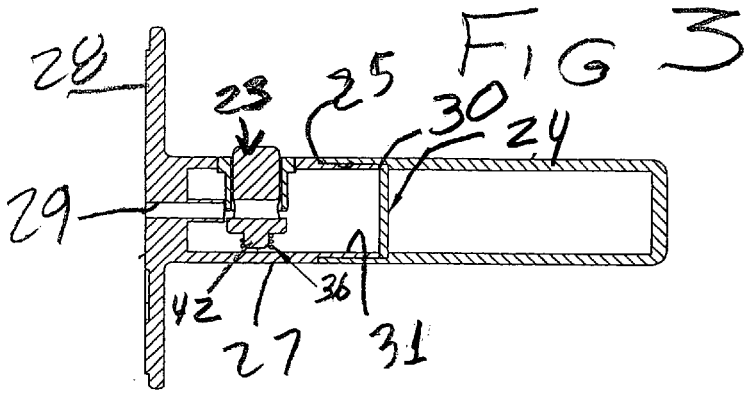
FIG. 3 is a cross-sectional side elevation view of the holding system of the present invention.
Figure 4:
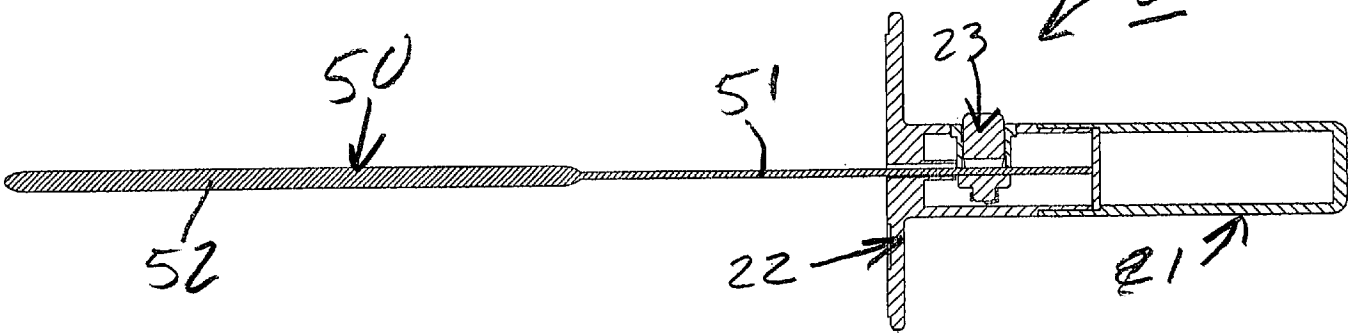
FIG. 4 is a cross-sectional side elevation view of the holding system of the present invention depicted with a sparkler securely mounted therewith.
Figure 5:
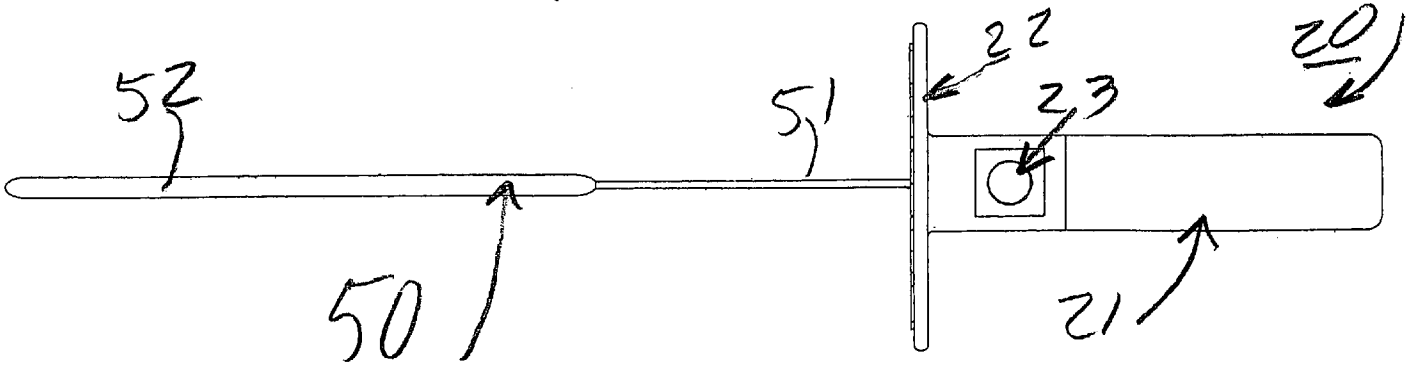
FIG. 5 is a top plan view of the holding system of FIG. 4.

In FIGS. 1-3, the preferred embodiment for constructing pyrotechnic device holding system 20 of the present invention is fully detailed. As depicted therein, pyrotechnic device holding system 20 comprises lower shaft member 21, upper shaft and flange member 22, lock assembly 23, and stop disk 24. By employing these easily constructed and assembled basic components, a highly effective, efficient, and easily employed pyrotechnic device holding system is realized which enables users to safely hold, display, ignite, and use any desired shaft supported pyrotechnic device.

Although pyrotechnic device holding system 20 of the present invention may be constructed in a wide variety of alternate designs and configurations, FIGS. 1-3 clearly depict the preferred embodiment and construction details of the present invention. In this regard, lower shaft member 21 is preferably constructed as a hollow cylindrical tube member having an upper end defined by portal 25, and a terminating end defined by bottom wall 26. In addition, as internal diameter which is greater than the internal diameter of lower shaft member 21 adjacent end wall 26. This results in the thickness of the side wall of lower shaft member 21 being reduced in the area adjacent portal 25. Furthermore, the reduced thickness zone extends axially into a portion of the interior of lower shaft member 21, terminating with ledge 32.

In addition, upper shaft/flange member 22 comprises a hollow cylindrical shaft portion 27 in combination with enlarged, radially extending flange 28. As detailed above, flange 28 preferably extends radially from the upper end of shaft portion 27. However, if desired, flange 28 may be positioned at any desired alternate location along the length of shaft 27.

Furthermore, in the preferred construction, flange 28 incorporates a centrally located aperture and passageway 29 formed therein which extends through flange 28 into hollow shaft portion 27. In addition, shaft portion 27 incorporates portal 30 formed in the terminating end thereof, with portal 30 being directly adjacent reduced diameter collar portion 31. As is more fully detailed below, the axial length of collar portion 31 is substantially equivalent to the axial length between ledge 32 and portal 25 of lower shaft member.

By employing this construction, the assembly of pyrotechnic device holding system 20 is quickly and easily achieved by constructing stop disk 24 with a diameter substantially equivalent to the outer diameter of collar portion 31 and placing stop disk 24 directly adjacent portal 30 of collar 31. Then, lower shaft member 21 is securely mounted in engagement with collar 31 of hollow shaft portion 27 by telescopically inserting collar 31 of hollow shaft portion 28 into portal 25 of lower shaft member 21.

In this way, these two components are quickly interengaged with each other, with stop disk 24 positioned at the base of collar 31 securely abutting portal 30 and engaged with ledge 32 of lower shaft member 21. Finally, in order to assure that these components are maintained in secure, locked interconnected engagement, these components are preferably affixed to each other by employing any desired bonding material or bonding means.

In the preferred construction, collar 31 and the reduced thickness portion of lower shaft member 21 extending between portal 25 and ledge 32 combine to form an overall thickness substantially equivalent to the overall outside diameter of lower shaft member 21 and hollow shaft portion 27 of upper shaft/flange member 22. In this way, a smooth, substantially continuous surface is achieved extending from wall 26 to flange 28.

In accordance with the present invention, lock assembly 23 is mounted in upper shaft/flange member 22 in order to enable pyrotechnic device holding system 20 to securely hold and lockingly maintain the shaft of any desired pyrotechnic device in holding system 20, preventing the pyrotechnic device from causing damage or injury to the user. In this regard, in addition to securely affixing the shaft of the pyrotechnic device to holding system 20, holding system 20 also incorporates enlarged flange 28 for protecting the hand of the user from being contacted by any of the sparks emanating from the pyrotechnic device. In this way, assurance is provided that the user remains safe and injury-free by employing pyrotechnic device holding system 20 with any desired shaft bearing pyrotechnic display member.

As best seen in FIGS. 1-3 and 6-7, in the preferred construction, lock assembly 23 incorporates cylindrically shaped button forming rod member 36, button/rod holder or retainer 37, and spring member 38. In the preferred embodiment, button forming rod member 36 incorporates top surface 40 and bottom surface 41, with mounting post 42 extending from bottom surface 41.

As depicted, mounting post 42 is constructed for receiving and holding spring member 38 in the desired position for continuously exerting a biasing force on button forming rod member 36. In addition, rod member 36 also incorporates two fins or ridges 43 radially extending outwardly from the cylindrical surface of rod member 36 in combination with a substantially circular shaped ledge 44 formed adjacent bottom surface 41. Finally, passageway 45 is formed in rod member 36 adjacent ledge 44 and extending through the entire diameter of rod member 36.

Furthermore, button holder/retainer 37 is constructed for peripherally surrounding button forming rod member 36 and for controlling the vertical movement of button forming rod member 36 against the biasing forces of spring member 38. In this regard, button holder/retainer 37 incorporates mounting panel 47 and side wall 48. As depicted, sidewall 48 is formed extending from mounting panel 47 and is constructed for peripherally surrounding and cooperating with button forming rod member 36. In addition, sidewall 48 of holder/retainer 37 incorporates slots 49 formed therein and positioned for cooperating with radially extending fins/ridges 43 of rod member 36.

When fully assembled, lock assembly 23 is mounted in a receiving aperture formed in hollow shaft portion 27 of upper shaft/flange member 22. In its mounted position, spring member 38 contacts the inside surface of hollow shaft portion 27 while mounting panel 47 of button holder/retainer 36 is positioned in secure interengagement with a receiving zone formed in the outer surface of hollow shaft portion 27. In addition, button forming rod member 36 is mounted between holder/retainer 37 and spring member 38, with spring member 38 exerting a biasing force on button forming rod member 36, forcing rod member 36 to be maintained in a position extending outwardly from holder/retainer 37.

Figure 7:
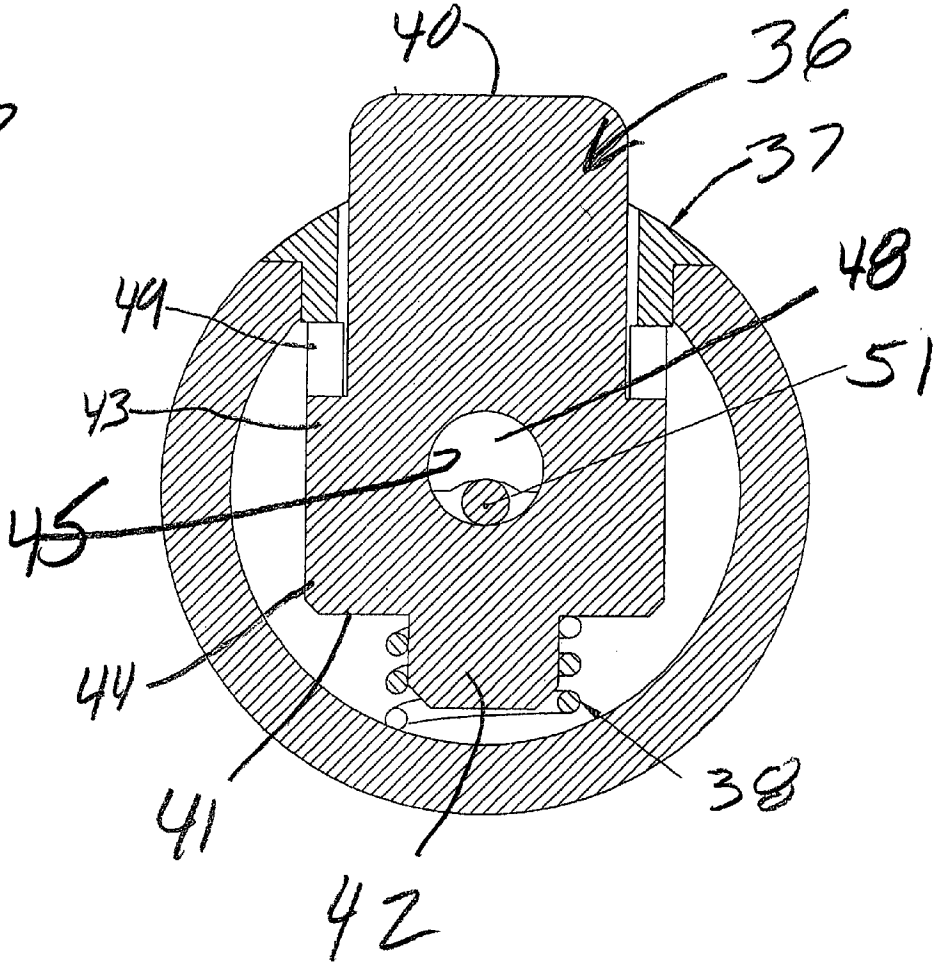
FIG. 7 is a cross-sectional view taken a long line 7-7 of FIG. 5, depicting the locking assembly in the holding system.
Figure 6:
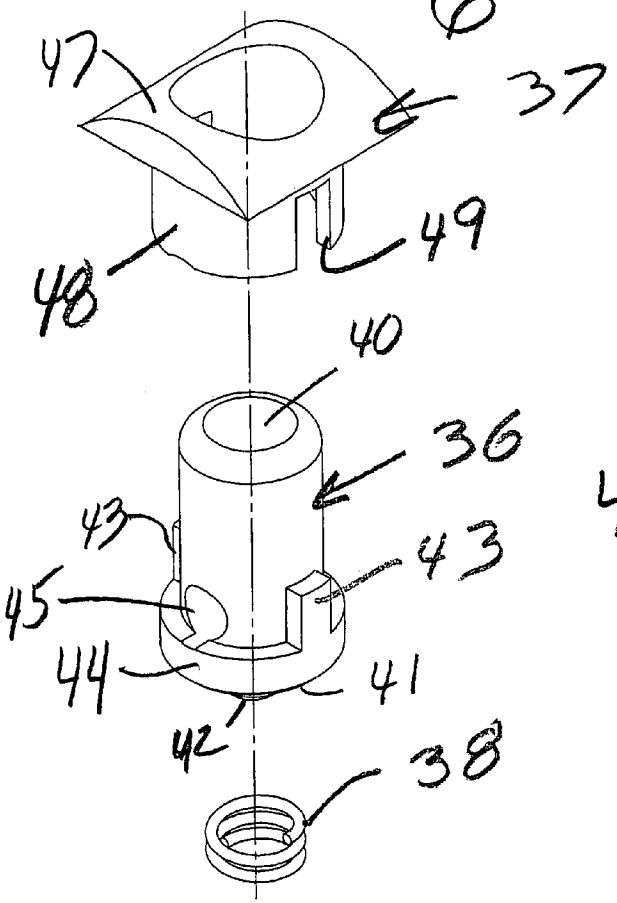
FIG. 6 is an exploded perspective view of the locking assembly forming an integral component of the holding system of the present invention.

When in the fully assembled position, as clearly depicted in FIGS. 2, 3, and 7, top surface 40 of button forming rod member 36 extends outwardly from mounting panel 47 of holder/retainer 37, with radially extending flanges/ridges 43 of rod member 36 engaged in slots 49 of holder/retainer 37. Due to the interengagement between flanges/ridges 43 and slots 49, further upward movement of button forming rod member 36 is prevented. However, whenever a force is applied to top surface 40 of button forming rod member 36 by a user, button forming rod member 36 can be axially moved downwardly, into hollow shaft portion 27, with button forming rod member 36 returning to its original position whenever the downward force is removed.

As clearly depicted in FIGS. 2-5 and 7, whenever pyrotechnic device holding system 20 is to be employed, the user merely applies a downward activating force to top surface 40 of button forming rod member 36 for causing passageway 45 to move below the terminating edge of sidewall 48. When in this position, passageway 45 of button forming rod member 36 is substantially aligned with portal/passageway 29 of flange 28 of upper shaft/flange member 22. Once portal/passageway 29 is aligned with passageway 45, any desired pyrotechnic device 50 is able to be quickly and easily inserted into pyrotechnic device holding system 20.

In this regard, shaft 51 of pyrotechnic device 50 is aligned with portal/passageway 29 and inserted through portal/passageway 29. Then, shaft 51 is advanced through portal/passageway 29 as well as through passageway 45 of button forming rod member 36. The advance of shaft 51 into pyrotechnic device holding system 20 is continued until the terminating end of shaft 51 contacts stop disk 24.

Once shaft 51 reaches stop disk 24, the user releases the force applied to button forming rod member 36, causing button forming rod member 36 to be biased upwardly by spring member 38. This biasing force causes passageway 45 to move upwardly effectively locking shaft 51 of pyrotechnic device 50 in passageway 45 and side walls 48 of holder/retainer 37. With spring member 48 continuously exerting this biasing force, shaft 51 is effectively clamped between these components, and is incapable of being dislodged or accidentally removed therefrom.

As a result, the desired secure, locked interengagement of pyrotechnic device 50 in holding system 20 of the present invention is attained in a quick and easily achieved manner. Furthermore, as is evident from the foregoing detailed discussion, pyrotechnic device 50, with its pyrotechnic element 52 affixed to shaft 51 are maintained in spaced distance away from lower shaft member 21 which would be employed by the user to hold pyrotechnic device 50. Consequently, once ignited, the user is assured that any sparks emanating from pyrotechnic device 50 are prevented from causing injury to the user.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A holding system for enabling a support shaft containing a pyrotechnic device to be safely held, said holding system comprising:

A. an elongated hollow shaft member incorporating
  a) a distal end and a proximal end, and
  b) a first passageway formed in the proximal end and extending into an interior of the shaft member;

B. a lock assembly mounted in the hollow shaft member and comprising
  a) an elongated rod mounted for axial movement relative to the shaft member and comprising a second passageway formed therein, said second passageway being movable into aligned relationship with the first passageway of the shaft member, and
  b) a spring member mounted in controlling engagement with the elongated rod for continuously exerting a biasing force on the elongated rod for normally maintaining the elongated rod in a first position wherein the first passageway and second passageway are in a non-aligned relationship, and being responsive to a counteracting force for causing the elongated rod to be moved axially into a second position wherein the first passageway and the second passageway are aligned, thereby allowing a support shaft of a pyrotechnic device to be inserted through the first passageway and the second passageway, causing the support shaft to be locked therein when said counteracting force is removed; and
  c) wherein the holding system is further defined as comprising a lower cylindrically shaped shaft forming member and an upper shaft and flange forming member, said members being mounted in secure interengagement with each other, wherein the lower cylindrically shaped shaft forming member is further defined as comprising a hollow cylindrical shape incorporating a closed distal end and a proximal end having an entry portal formed therein and comprising an axially extending reduced thickness zone terminating with a radial, inwardly extending ledge, wherein said system further comprises a stop disk inserted into the proximal end of the lower cylindrically shaped shaft forming member in cooperating relationship with the radial, inwardly extending ledge thereof and for being maintained in this position;

whereby a holding system is attained which is capable of securely lockingly engaging and holding the support shaft of a pyrotechnic containing device for spacing the pyrotechnic device away from the holder.

2. The holding system defined in claim 1, wherein said system further comprises an enlarged flange radially extending outwardly from the elongated shaft member in a position for preventing injury to the holder from the use of the pyrotechnic device.

3. The holding-system defined in claim 2, wherein the enlarged flange is further defined as being formed about the proximal end of the shaft member.

4. The holding system defined in claim 3, wherein the upper shaft and flange forming member comprises a hollow cylindrically shaped shaft forming portion constructed for mating, telescopic interengagement into the proximal end of the lower cylindrically shaped shaft forming portion.

5. The holding system defined in claim 4, wherein the lock assembly is further defined as comprising a rod holder/retainer securely mounted to the upper shaft and flange forming member in co-operating, controlled engagement with the elongated rod for controllably limiting the axial movement of the elongated rod relative to the shaft member.

6. The holding system defined in claim 5, wherein said rod holder/retainer is further defined as comprising sidewalls for peripherally surrounding the elongated rod, with said sidewalls incorporating axial slots formed therein, and said elongated rod is further defined as comprising radially extending fins formed on the outer surface thereof positioned for cooperative sliding interengagement with the slots of the holder/retainer, whereby the axial movement of the elongated rod is controlled by the movement of the fins in the slots.

7. The holding system defined in claim 6, wherein the sidewalls of the holder/retainer are further defined as being positioned for cooperating with the second passageway formed in the elongated rod for substantially closing the passageway when the elongated rod is in its first position and for opening the second passageway whenever the elongated rod is moved into its second position, whereby the sidewalls cooperate with the first passageway for securely affixing and lockingly engaging the shaft of the pyrotechnic device whenever the pyrotechnic device is inserted therein.

8. A holding system for enabling a shaft containing pyrotechnic device to be safely held, said holding system comprising:

A. a lower cylindrically shaped shaft forming member is further defined as comprising a hollow cylindrical shape incorporating a closed distal end and a proximal end having an entry portal formed therein and comprising an axially extending reduced thickness zone terminating with a radial, inwardly extending ledge B. an upper shaft and flange forming member comprising a) a hollow cylindrically shaped shaft forming portion constructed for mating, telescopic interengagement into the proximal end of the lower cylindrically shaped shaft forming portion, and b) an enlarged flange portion extending from the shaft forming portion and incorporating a first passageway formed therein and extending into the shaft forming portion;

C. a lock assembly mounted in the shaft forming portion of the upper, shaft flange member and comprising a) an elongated rod mounted for axial movement relative to the shaft member and comprising a second passageway formed therein, said second passageway being movable into aligned relationship with the first passageway of the shaft member, b) a spring member mounted in controlling engagement with the rod for continuously exerting a biasing force on the elongated rod for normally maintaining the elongated rod in a first position wherein the first passageway and second passageway are in a non-aligned relationship, and being responsive to a counteracting force for causing the elongated rod to be moved axially into a second position wherein the first passageway and the second passageway are aligned, c) a rod holder/retainer securely mounted to the upper shaft and flange forming member in co-operating, controlled engagement with the elongated rod for controllably limiting the axial movement of the elongated rod relative to the shaft member; and D. a stop disc inserted into the proximal end of the lower cylindrically shaped shaft forming member in cooperating relationship with the radial, inwardly extending ledge thereof and for being maintained in this position when the hollow cylindrically shaped shaft forming portion of the upper shaft and flange forming member is inserted therein;

whereby a support shaft of a pyrotechnic device may be inserted through the first passageway and the second passageway, causing the support shaft to be locked therein when said counteracting force is removed and a holding system is attained which is capable of securely lockingly engaging and securing the support shaft of a pyrotechnic containing device for spacing the pyrotechnic device away from the holder.

9. The holding system defined in claim 8 wherein said rod holder/retainer is further defined as comprising sidewalls for peripherally surrounding the elongated rod, with said sidewalls incorporating axial slots formed therein, and said elongated rod is further defined as comprising radially extending fins formed on the outer surface thereof positioned for cooperative sliding inter-engagement with the slots of the holder/retainer, whereby the axial movement of the elongated rod is controlled by the movement of the fins in the slots.

10. The holding system defined in claim 9, wherein the sidewalls of the holder/retainer are further defined as being positioned for cooperating with the second passageway formed in the elongated rod for substantially closing the passageway when the elongated rod is in its first position and for opening the second passageway whenever the elongated rod is moved into its second position, whereby the sidewalls cooperate with the first passageway for securely affixing and lockingly engaging the support shaft of the pyrotechnic device whenever the pyrotechnic device is inserted therein.

* * * * *